US005919415A

United States Patent [19]

Pichard

[11] Patent Number: 5,919,415

[45] Date of Patent: Jul. 6, 1999

[54] STEEL AND PROCESS FOR THE MANUFACTURE OF A STEEL COMPONENT FORMED BY COLD PLASTIC DEFORMATION

[75] Inventor: Claude Pichard, Malancourt la Montagne, France

[73] Assignee: Ascometal, Puteaux, France

[21] Appl. No.: 09/001,078

[22] Filed: Dec. 31, 1997

[30] Foreign Application Priority Data

Dec. 31, 1996 [FR] France ..... 96 16254

[51] Int. Cl.[6] ..... C22C 38/22; C22C 38/12; C21D 8/00

[52] U.S. Cl. ..... 420/106; 420/110; 420/121; 420/126; 148/334; 148/320; 148/650; 148/654

[58] Field of Search ..... 420/106, 110, 420/121, 126; 148/334, 320, 650, 654

[56] References Cited

U.S. PATENT DOCUMENTS

| | | | |
|---|---|---|---|
| 5,407,635 | 4/1995 | Iseda et al. | 420/106 |
| 5,762,725 | 6/1998 | Pichard et al. | 420/106 |

FOREIGN PATENT DOCUMENTS

| | | |
|---|---|---|
| 0 191 873 | 8/1986 | European Pat. Off. . |
| 0 747 496 | 12/1996 | European Pat. Off. . |
| 2 186 594 | 8/1987 | United Kingdom . |

OTHER PUBLICATIONS

Patent Abstracts of Japan, vol. 018, No. 647, Dec. 8, 1994 & JP 06 248341 A (Sumitomo Metal Ind Ltd), Sep. 6, 1994.

Patent Abstracts of Japan, vol. 017, No. 382, Jul. 19, 1993 & JP 05 065540 A (Nissan Motor Co Ltd), Mar. 19, 1993.

*Primary Examiner*—Deborah Yee

*Attorney, Agent, or Firm*—Oblon, Spivak, McClelland, Maier & Neustadt, P.C.

[57] ABSTRACT

The invention relates to a steel and to a process for the manufacture of a steel component formed by cold plastic deformation.

19 Claims, No Drawings

STEEL AND PROCESS FOR THE MANUFACTURE OF A STEEL COMPONENT FORMED BY COLD PLASTIC DEFORMATION

PRIOR ART

Many steel components, and in particular machine components having high properties, are manufactured by cold forging or cold striking, and more generally by cold plastic deformation of hot-rolled steel blanks. The steel used has a carbon content of between 0.2% and 0.42% (by weight). It is alloyed either with chromium, or with chromium-molybdenum, or with nickel-chromium, or with nickel-chromium-molybdenum, or, finally, with manganese-chromium so as to be sufficiently hardenable in order to allow a martensitic structure to be obtained after quenching, which structure is necessary for obtaining, after annealing, the desired mechanical properties which are, on the one hand, a high tensile strength and, on the other hand, good ductility. In order to be able to be cold formed, the steel must be subjected beforehand to a spheroidizing or "maximum-softening" heat treatment consisting of holding it at a temperature above 650° C. for a long time, which may possibly be several tens of hours. This treatment gives the steel a spheroidized perlitic structure, which is easy to cold deform. This technique has the drawback, in particular, of requiring three heat treatments, which complicates the manufacture and increases the costs.

SUMMARY OF THE INVENTION

The object of the present invention is to remedy this drawback by providing a means for manufacturing a mechanical component made of a steel having high properties by forming it by cold plastic deformation, without it being necessary to perform a spheroidizing or maximum-softening heat treatment or an annealing heat treatment.

To this end, the subject of the invention is a steel for the manufacture of a steel component formed by cold plastic deformation, the chemical composition of which comprises, by weight:

$0.03\% \leqq C \leqq 0.16\%$ $0.5\% \leqq Mn \leqq 2\%$ $0.05\% \leqq Si \leqq 0.5\%$ $0\% \leqq Cr \leqq 1.8\%$ $0\%\ Mo \leqq 0.25\%$ $0.001\% \leqq Al \leqq 0.05\%$ $0.001\% \leqq Ti \leqq 0.05\%$ $0\% \leqq V \leqq 0.15\%$ $0.0005\% \leqq B \leqq 0.005\%$ $0.004\% \leqq N \leqq 0.012\%$ $0.001\% \leqq S \leqq 0.09\%$ optionally up to 0.005% of calcium, up to 0.01% of tellurium, up to 0.04% of selenium and up to 0.3% of lead, the balance being iron and impurities resulting from the smelting, the chemical composition of the steel furthermore satisfying the relationships:

$$Mn+0.9\times Cr+1.3\times Mo+1.6\times V \geqq 2.2\%$$

and $$Al+Ti \geqq 3.5\times N.$$

Preferably, the chemical composition of the steel is such that:

$0.06\% \leqq C \leqq 0.12\%$ $0.8\% \leqq Mn \leqq 1.7\%$ $0.1\% \leqq Si \leqq 0.35\%$ $0.1\% \leqq Cr \leqq 1.5\%$ $0.07\% \leqq Mo \leqq 0.15\%$ $0.001\% \leqq Al \leqq 0.035\%$ $0.001\% \leqq Ti \leqq 0.03\%$ $0\% \leqq V \leqq 0.1\%$ $0.001\% \leqq B \leqq 0.004\%$ $0.004\% \leqq N \leqq 0.01\%$ $0.001\% \leqq S \leqq 0.09\%$ optionally up to 0.005% of calcium, up to 0.01% of tellurium, up to 0.04% of selenium and up to 0.3% of lead, the balance being iron and impurities resulting from the smelting.

It is preferable for the contents of impurities or residual elements to be, simultaneously or separately, such that:

$Ni \leqq 0.25\%$ $Cu \leqq 0.25\%$.

$P \leqq 0.02\%$.

The invention also relates to a process for the manufacture of a steel component formed by cold plastic deformation, which includes, as sole heat treatment, a quench. The term "quench" is used, here and throughout the following, in the wide sense, that is to say what is meant is a cooling step sufficiently rapid to obtain a structure which is practically not ferrito-perlitic and which is not essentially martensitic either.

Apart from the quench, the process consists in hot rolling a steel semi-finished product in order to obtain a hot-rolled product, optionally in cutting a blank from the hot-rolled product and in forming the blank or the rolled product by cold plastic deformation.

The quench, which is intended to give the component an essentially bainitic structure, may be carried out equally well before the cold forming as after it. When the quench is carried out before the cold forming, it may be performed equally well immediately in the hot as-rolled state as after austenization by reheating to above $AC_3$. When the quench is carried out after the cold forming, it is performed after austenization by reheating to above $AC_3$.

Finally, the invention relates to a steel component obtained by cold forming, made of a steel according to the invention, such that the reduction in section Z of the steel is greater than 45%, preferably greater than 50%, and the tensile strength $R_m$ is greater than 650 MPa and even, for some applications, greater than 1200 MPa. In general, and this is desirable, the component has an essentially bainitic structure, i.e. it consists of more than 50% of bainite.

The invention will now be described in more detail and illustrated by the examples which follow.

The chemical composition of the steel according to the invention comprises, in % by weight:

from 0.03% to 0.16%, and preferably from 0.06% to 0.12%, of carbon in order to obtain a high work-hardenability during cold forming, to prevent the formation of coarse carbides unfavorable to ductility and to allow cold forming to be undertaken without it being necessary to perform a spheroidizing or maximum-softening annealing operation;

from 0.5% to 2%, and preferably from 0.8% to 1.7%, of manganese in order to ensure good castability and to obtain sufficient hardenability and the desired mechanical properties;

from 0.05% to 0.5%, and preferably from 0.1% to 0.35%, of silicon, which element is necessary for deoxidizing the steel, in particular when the aluminum content is low, but which, in too high a quantity, promotes hardening prejudicial to cold-formability and to ductility;

from 0% to 1.8%, and preferably from 0.1% to 1.5%, of chromium in order to adjust the hardenability and the mechanical properties to the desired level for the components, without exceeding a value which would excessively harden the steel in the as-rolled state or which would lead to the formation of martensite prejudicial to cold-formability and to ductility;

from 0% to 0.25%, and preferably from 0.07% to 0.15%, of molybdenum in order, synergistically with boron, to ensure homogeneous hardenability over the various sections of the component;

optionally, from 0% to 0.15%, and preferably less than 0.1%, of vanadium in order to obtain high mechanical properties (tensile strength) when these are required;

from 0.0005% to 0.005%, and preferably from 0.001% to 0.004%, of boron in order to increase the necessary hardenability;

from 0% to 0.05%, and preferably from 0.001% to 0.035%, of aluminum and from 0% to 0.05%, and preferably from 0.001% to 0.03%, of titanium, the sum of the aluminum and titanium contents having to be greater than or equal to 3.5 times the nitrogen content, so as to obtain a fine grain structure necessary for good cold-formability and good ductility;

from 0.004% to 0.012%, and preferably from 0.006% to 0.01%, of nitrogen in order to control the grain size by forming aluminum nitrides, titanium nitrides or vanadium nitrides, without forming boron nitrides;

more than 0.001% of sulfur so as to ensure a minimum machinability, in order to allow final retouching of the components, but less than 0.09% in order to guarantee good cold-formability; machinability combined with good formability, by cold plastic deformation, may be improved either by adding calcium up to 0.005% or by adding tellurium up to 0.01%—in this case it is preferable for the Te/S ratio to remain close to 0.1—or by adding selenium up to 0.05%—in this case it is preferable for the selenium content to remain close to the sulfur content—or, finally, by adding lead up to 0.3%—in this case the sulfur content must be reduced;

the balance is iron and impurities resulting from the smelting.

The impurities are, in particular:

phosphorus, the content of which must preferably remain less than or equal to 0.02% in order to guarantee good ductility during and after cold forming;

copper and nickel, both regarded as residual elements, the content of each of which must preferably remain less than 0.25%.

Finally, the chemical composition of the steel must satisfy the relationship:

$$Mn+0.9\times Cr+1.3\times Mo+1.6\times V\geqq 2.2\%$$

which ensures that the combination of the manganese, chromium, molybdenum and vanadium contents makes it possible to obtain the desired strength characteristics and an essentially bainitic structure.

This steel has the advantage of being able to undergo cold plastic deformation very easily and of making it possible to obtain, without it being necessary to temper the steel, a structure of the bainitic type having excellent ductility and high mechanical properties. In particular, the ductility may be measured by the reduction in section Z, which is greater than 45% and even greater than 50%. The tensile strength Rm is greater than 650 MPa and may exceed 1200 MPa. These properties may be obtained both when the quench is carried out while the steel is still hot from rolling before cold forming and when it is carried out after austenization by heating to above $AC_3$, before or after cold forming.

In order to manufacture a cold-formed component, a semi-finished product made of steel according to the invention is provided and this is hot rolled after reheating to above 940° C. in order to obtain a hot-rolled product such as a bar, a billet or a wire rod.

DESCRIPTION OF THE PREFERRED EMBODIMENTS

In a first embodiment, the hot rolling is stopped at a temperature of between 900° C. and 1050° C. and the hot-rolled product is quenched directly while it is still hot from rolling by cooling it using blown air, oil, mist, water or water to which polymers have been added, depending on its cross section. The product thus obtained is then cut into blanks and then cold formed, for example by cold forging or by cold striking. The final mechanical properties, obtained directly after cold forming, result in particular from the work-hardening produced by the cold-forming operation.

In a second embodiment, after hot rolling, either the rolled product is quenched after austenization and then cut into blanks which are formed by cold plastic deformation, or the blanks are cut before quenching and then cold forming. In both cases, the austenization consists in heating between $AC_3$ and 970° C. and the quench is carried out by cooling in blown air, oil, mist, water or water to which polymers are added, depending on the cross section of the product. The final mechanical properties, obtained immediately after cold forming, result in particular from the work-hardening produced by the forming operation. In this embodiment, the end-of-rolling conditions are of no particular importance.

In a third embodiment, the cold-forming operation is carried out on a blank cut from the hot-rolled product and the quench is carried out after cold forming. As in the previous case, the quench is carried out after heating between $AC_3$ and 970° C. and by cooling in blown air, oil, mist, water or water to which polymers are added. The end-of-rolling conditions are, again, of no particular importance.

The invention intended more particularly for the manufacture of mechanical components also applies to the manufacture of cold-drawn bars, drawn wires and peeled wire rods, the cold drawing, the wire-drawing and the peeling being particular methods of forming by cold plastic deformation. The drawn bars and the wire rods or drawn wires may be scalped, shaved or ground so as to have a surface finish free of defects. The term "cold-formed steel component" covers all these products and the term "blank" covers, in particular, any portion of a bar, rod or wire; in some cases, the bars, rods or wires are not cut into blanks before being cold formed.

Finally, the invention can be used to manufacture pre-treated bars or pre-treated rods or wires, or more generally pre-treated ferrometallurgical products, intended to be used in this state for the manufacture of components by cold forming without additional heat treatment. These ferrometallurgical products are quenched after hot rolling either immediately while they are still hot from rolling, or after austenization, so as to present an essentially bainitic structure (bainite≧50%). They may be scalped or shaved in order to have a surface finish free of defects.

The invention will now be illustrated by examples.

1ST EXAMPLE

A steel according to the invention was smelted, the chemical composition of which comprised, by weight:

C=0.065%
Mn=1.33%
Si=0.34%
S=0.003%
P=0.014%
Ni=0.24%
Cr=0.92%
Mo=0.081%
Cu=0.23%
V=0.003%
Al=0.02%
Ti=0.02%
N=0.008%
B=0.0035% therefore fulfilling the conditions:

$$Mn+0.9\times Cr+1.3\times Mo+1.6\times V=2.27\%\geqq 2.2\%$$

and $$Al+Ti=0.040\%\geqq 3.5\times N=0.028\%.$$

With this steel, billets were manufactured which were hot rolled after reheating to above 940° C. in order to form rounds (or bars) having diameters of 16 mm, 25.5 mm and 24.8 mm.

1) 16 mm diameter rounds:

The rolling of the 16 mm diameter rounds was stopped at 990° C. and the rounds were quenched while still hot from rolling under the following three conditions (in accordance with the invention):

A: cooling at a rate of 5.3° C./s, equivalent to a blown-air quench;

B: cooling at a rate of 26° C./s, equivalent to an oil quench;

C: cooling at a rate of 140° C./s equivalent to a water quench.

The mechanical properties, before cold forming, of the quenched rounds and their ability to be formed by cold plastic deformation have been evaluated by tensile and torsional tests to break carried out cold (the results of the torsional tests are expressed in "number of revolutions before the test piece broke"). The results were as follows:

| Quenching conditions | Hardness of the round before torsion (HV) | Strength before torsion (MPa) | Reduction in section Z before torsion (%) | Number of revolutions to break |
|---|---|---|---|---|
| A | 234 | 734 | 69 | 4.7 |
| B | 318 | 1001 | 73 | 5.2 |
| C | 350 | 1103 | 69 | 5 |

The hardness and the tensile strength, which vary considerably with the quenching conditions, increase as the cooling rate increases. However, in all cases, the ductility and the cold deformability are excellent since the reduction in section Z is always substantially greater than 50% and the number of revolutions at break is always well above 3.

In order to determine the mechanical properties which can be obtained on components manufactured by forming by cold plastic deformation using these same rounds, cold torsion-tension tests were carried out, the results of which were as follows:

| Quenching conditions | Strength after 3 revolutions of twisting (MPa) | Reduction in section after 3 revolutions of twisting, Z (%) | Increase in strength after 3 revolutions of twisting (%) |
|---|---|---|---|
| A | 919 | 66 | 25% |
| B | 1189 | 67 | 19% |
| C | 1245 | 68 | 13% |

The cold torsion-tension test consists in subjecting a test piece to 3 cold revolutions of twisting in order to simulate the forming by plastic deformation, before carrying out a tensile test at room temperature. The increase in strength corresponds to the relative increase in strength between the work-hardened state (after 3 revolutions of twisting) and the normal state (before the 3 revolutions of twisting).

The results obtained show that, even after a large cold deformation (3 revolutions of twisting), the reduction in section remains greater than 50% and that the tensile strength can exceed 1200 MPa. The work-hardenability, measured by the increase in strength after deformation by cold twisting, is high in all cases.

2) Rounds 25.5 mm in diameter:

The rounds of 25.5 mm diameter were quenched before cold forming, after austenization at 950° C., under the following conditions (in accordance with the invention):

D: blown-air cooling (average cooling rate of 3.3° C./s between 950° C. and room temperature);

E: oil cooling (average cooling rate of 22° C./s between 950° C. and room temperature);

F: water cooling (average cooling rate of 86° C./s between 950° C. and room temperature).

The rounds were subjected to cold-forging forming tests consisting in measuring the Limiting Crush Factor (L.C.F.) by crushing cylinders which are notched along a generatrix. The Limiting Crush Factor, expressed in %, is the amount of crushing above which the first crack appears during cold press forging in the notch made along the generatrix of the cylinder.

By way of comparison, the L.C.F. was also measured on a cold-forging steel according to the prior art, the composition of which was:

C=0.37%
Mn=0.75%
Si=0.25%
S=0.005%
Cr=1%
Mo=0.02%
Al=0.02%

This steel according to the prior art had been subjected beforehand to an annealing operation for spheroidizing the perlite in order to make it suitable for cold deformation.

The results obtained were as follows:

| Steel | Heat treatment | Hardness (HV) | Strength (MPa) | Limiting Crush Factor, % |
|---|---|---|---|---|
| Steel according to the invention | D | 249 | 793 | 52 |
| | E | 303 | 954 | 52 |
| | F | 355 | 1115 | 52 |
| Steel according to the prior art | Spheroidizing annealing | 174 | 547 | 44 |

In view of the Limiting Crush Factors, it seems that the steel according to the invention has a substantially greater formability by cold forging than the steel according to the prior art despite a higher hardness and whatever the strength level, even if this is high (treatment F).

3) Rounds 24.8 mm in diameter:

After rolling and before cold forming, 24.8 mm diameter rounds were quenched before austenization at 930° C. under the following conditions in accordance with the invention:

G: blown-air quench

H: oil quench.

The rounds thus treated were cold forged in order to manufacture stub axles for motor-vehicle wheels, the measured mechanical properties of which were as follows:

| Treatment | Strength (MPa) | Reduction in section Z (%) |
|---|---|---|
| G | 741 | 71 |
| H | 984 | 74 |

These results show that, whatever the initial treatment, the ductility obtained on a cold-forged component is very high (Z≧50%), and this being so independently of the strength level.

Moreover, in both cases the rounds were very suitable for forming by cold forging since the components have proved to be free of any defect, either internal or external.

Using other 24.8 mm diameter rounds (identical to the previous ones), the same stub axles were manufactured by cold forging the as-rolled rounds, carrying out the quench after the cold-forming operation. The quench was carried out in water after austenization at 940° C.

Under these conditions, the properties obtained on stub axles were as follows:

$R_m$=1077 MPa

Z73%

These results show that with steel according to the invention, it is possible to obtain very good ductility (Z≧50%), despite a high strength level, by quenching after a round has been cold forged in the as-hot-rolled state. Moreover, the steel according to the invention proved to be perfectly suitable for forming by cold forging in the as-rolled state without requiring a prior spheroidizing treatment, as is performed on steels according to the prior art, the stub axles having been shown, in fact, to be free of any defect, either internal or external.

By way of comparison, according to the prior art, a steel of composition:

C=0.195%

Mn=1.25%

Si=0.25%

S=0.005%

Ni=0.25%

Cr=1.15%

Mo=0.02%

Cu=0.2%

Al=0.02% is used to manufacture the same stub axles.

In order to obtain mechanical properties similar to those obtained with the invention, it is necessary to use the following manufacturing scheme:

Spheroidizing annealing of the steel in order to make it suitable for cold forming;

Cold forging of the stub axles;

Oil quenching of the steel according to the prior art;

Tempering of the steel according to the prior art.

2ND EXAMPLE

Mechanical components were also manufactured by cold striking, using Steels 1 and 2 in accordance with the invention, the chemical compositions of which in % by weight were:

| | Steel 1 | Steel 2 |
|---|---|---|
| C = | 0.061% | 0.062% |
| Mn = | 1.6% | 1.57% |
| Si = | 0.28% | 0.29% |
| S = | 0.021% | 0.021% |
| P = | 0.004% | 0.004% |
| Ni = | 0.11% | 0.11% |
| Cr = | 0.81% | 0.8% |
| Mo = | 0.081% | 0.128% |
| Cu = | 0.2% | 0.2% |
| Al = | 0.028% | 0.025% |
| Ti = | 0.017% | 0.016% |
| V = | 0.002% | 0.084% |
| B = | 0.0039% | 0.0038% |
| N = | 0.007% | 0.008% |

therefore fulfilling the conditions:

in the case of Steel 1:

$$Mn+0.9\times Cr+1.3\times Mo+1.6\times V=2.43\geqq 2.2\%$$

$$Al+Ti=0.045\%\geqq 3.5\times N=0.024\%$$

in the case of Steel 2:

$$Mn+0.9\times Cr+1.3\times Mo+1.6\times V=2.59\geqq 2.2\%$$

$$Al+Ti=0.041\%\leqq 3.5\times N=0.028\%$$

In accordance with the invention, these steels were hot rolled in the form of bars 28 mm in diameter. After rolling and before cold forming, the bars were subjected to a warm-oil quench treatment at 50° C. after austenization at 950° C. The bars were cut up in order to form blanks from which the components were formed by cold striking with a degree of deformation of 60%. The mechanical properties obtained on the blanks before cold striking and on the components after cold striking were as follows:

| Steel | Hardness, HV, before cold striking | $R_m$ of the steel before cold striking (MPa) | $R_m$ on a component after cold striking (MPa) | Z on a component after cold striking (%) | Increase in $R_m$ on striking (%) (*) |
|---|---|---|---|---|---|
| 1 | 323 | 1019 | 1380 | 61 | 35 |
| 2 | 331 | 1038 | 1430 | 59 | 38 |

(*) = Cold-forming work-hardenability.

These results show that the ductility is high (Z≧50%) despite a very high degree of cold deformation, this being so independently of the initial strength level (before cold striking) and the final strength level (after cold striking) of the steel, even if the final strength level is very high. They also show that the work-hardenability, measured by the increase in strength on cold striking, is high.

Moreover, the cold-striking formability is excellent since, despite high initial strength levels and a high cold deformation (60%), the cold struck components proved to be free of defects, either internal or external.

These examples show that the steel and the processes according to the invention make it possible to obtain very good ductility (Z≧50%) by the manufacture of a component formed by cold plastic deformation, without it being necessary to carry out an expensive spheroidizing treatment or a tempering treatment. This high ductility (Z≧50%) combined with very high mechanical properties ($R_m$≧1200 MPa) on components may be obtained, in particular because of the high work-hardenability of the steel. Finally, the very good cold-forging or cold-striking formability is found even if the initial strength (or hardness) level of the steel and the degree of cold deformation are high.

I claim:

1. A steel whose chemical composition consists essentially of by weight:

| | | |
|---|---|---|
| 0.03% | C | 0.16% |
| 0.5% | Mn | 2% |
| 0.05 | Si | 0.5% |
| 0% | Cr | 1.8% |
| 0% | Mo | 0.25% |
| 0.001% | Al | 0.05% |
| 0.001% | Ti | 0.05% |
| 0% | V | 0.15% |
| 0.0005% | B | 0.005% |
| 0.004% | N | 0.012% |
| 0.001% | S | 0.09% |

optionally up to 0.005% of calcium, up to 0.01% of tellurium, up to 0.04% of selenium and up to 0.3% of lead, the balance being iron and impurities resulting from the smelting, the chemical composition of the steel furthermore satisfying the relationships:

$$Mn+0.9\times Cr+1.3\times Mo+1.6\times V\geqq 2.2\%$$

and $$Al+Ti\geqq 3.5\times N.$$

2. The steel as claimed in claim 1, wherein its chemical composition consists essentially of:

| | | |
|---|---|---|
| 0.06% | C | 0.12% |
| 0.8% | Mn | 1.7% |
| 0.1% | Si | 0.35% |
| 0.1% | Cr | 1.5% |
| 0.07% | Mo | 0.15% |
| 0.001% | Al | 0.035% |
| 0.001% | Ti | 0.03% |
| 0% | V | 0.1% |
| 0.001% | B | 0.004% |
| 0.004% | N | 0.01% |
| 0.001% | S | 0.09% |

optionally up to 0.005% of calcium, up to 0.01% of tellurium, up to 0.04% of selenium and up to 0.3% of lead, the balance being iron and impurities resulting from the smelting.

3. A steel as claimed in claim 2, wherein its chemical composition is such that:

Ni≦0.25%

Cu≦0.25%.

4. The steel as claimed in claim 2, wherein its chemical composition is such that:

P≦0.02%.

5. A process for the manufacture of a steel component formed by cold plastic deformation, wherein:

a semi-finished product made of steel as claimed in claim 1 is provided;

the semi-finished product is hot rolled after it has been reheated to a temperature above 940° C. and the rolling is stopped at a temperature of between 900° C. and 1050° C. in order to obtain a rolled product;

the rolled product is quenched immediately, whilst still hot from rolling, so as to give it an essentially bainitic structure;

optionally, a blank is cut from the rolled product; and the blank or the rolled product is formed by cold plastic deformation in order to obtain the component having its final mechanical properties.

6. A process for the manufacture of a steel component formed by cold plastic deformation, wherein:

a semi-finished product made of steel as claimed in claim 1 is provided;

the semi-finished product is hot rolled so as to obtain a rolled product;

the rolled product is quenched after it has been reheated to above the $AC_3$ point, so as to give it an essentially bainitic structure;

optionally, a blank is cut from the rolled product; and the blank or the rolled product is formed by cold plastic deformation in order to obtain the component having its final mechanical properties.

7. A process for the manufacture of a steel component formed by cold plastic deformation, wherein:

a semi-finished product made of steel as claimed in claim 1 is provided, the semi-finished product is hot rolled so as to obtain a rolled product;

optionally, a blank is cut from the rolled product;

the blank or the rolled product is formed by cold plastic deformation in order to obtain the component; and the component, after it has been reheated to above the $AC_3$ point, is quenched so as to give it an essentially bainitic structure and its final mechanical properties.

8. A cold-formed steel component, comprising a steel as claimed in claim 1, wherein the reduction in section Z is greater than 45% and the tensile strength $R_m$ of the steel is greater than 650 MPa.

9. The component as claimed in claim 8, wherein the tensile strength $R_m$ of the steel is greater than 1200 MPa.

10. The component as claimed in claim 8, wherein it has an essentially bainitic structure.

11. A hot-rolled ferrometallurgical product, comprising a steel as claimed in claim 1 and has an essentially bainitic structure.

12. A steel whose chemical composition consists of, by weight %:

C: 0.03–0.16

Mn: 0.5–2

Si: 0.05–0.5

Cr: 0–1.8

Mo: 0–0.25

Al: 0.001–0.05

Ti: 0.001–0.05

V: 0–0.15

B: 0.0005–0.005

N: 0.004–0.012

S: 0.001–0.09 wherein said steel optionally comprises up to 0.005% of calcium, up to 0.01% of tellurium, up to 0.04% of selenium and up to 0.3% of lead, the balance being iron and impurities resulting from smelting, and wherein the chemical composition of the steel satisfies the following relationships:

$$Mn+0.9\times Cr+1.3\times Mo+1.6\times V\geqq 2.2\%;$$

and $$Al+Ti\geqq 3.5\times N.$$

13. The steel as claimed in claim 12, whose chemical composition consists of, by weight%:

C: 0.06–0.12

Mn: 0.8–1.7

Si: 0.1–0.35

Cr: 0.1–1.5

Mo: 0.07–0.15

Al: 0.001–0.035

Ti: 0.001–0.03

V: 0–0.1

B: 0.001–0.004

N: 0.004–0.01

S: 0.001–0.09 wherein said steel optionally comprises up to 0.005% of calcium, up to 0.01% of tellurium, up to 0.04% of selenium and up to 0.3% of lead, the balance being iron and impurities resulting from smelting.

14. A steel as claimed in claim 13, whose chemical composition is such that:

$Ni\leqq 0.25\%$ $Cu\leqq 0.25\%$.

15. A steel as claimed in claim 13, whose chemical composition is such that:

$P\leqq 0.02\%$.

16. A hot-rolled ferrometallurigal product, which is made of a steel as claimed in claim 12 and has an essentially bainitic structure.

17. A cold-formed steel component, which is made of a steel as claimed in claim 12, wherein the reduction in section Z is greater than 45% and tensile strength $R_m$ of the steel is greater than 650 MPa.

18. The component as claimed in claim 17, wherein the tensile strength $R_m$ of the steel is greater than 1200 MPa.

19. The component as claimed in claim 17, wherein it has an essentially bainitic structure.

* * * * *